US009305697B2

(12) United States Patent
Tesson

(10) Patent No.: US 9,305,697 B2
(45) Date of Patent: Apr. 5, 2016

(54) INTEGRATED TRANSFORMER

(71) Applicant: NXP B.V., Eindhoven (NL)

(72) Inventor: Olivier Tesson, Bretteville l'Orgueilleuse (FR)

(73) Assignee: NXP, B.V., Eindhoven (NL)

( * ) Notice: Subject to any disclaimer, the term of this patent is extended or adjusted under 35 U.S.C. 154(b) by 0 days.

(21) Appl. No.: 14/573,630

(22) Filed: Dec. 17, 2014

(65) Prior Publication Data

US 2015/0170824 A1 Jun. 18, 2015

(30) Foreign Application Priority Data

Dec. 18, 2013 (EP) ..... 13290318

(51) Int. Cl.
*H01F 5/00* (2006.01)
*H01F 27/28* (2006.01)
*H01F 17/00* (2006.01)

(52) U.S. Cl.
CPC ..... *H01F 27/2804* (2013.01); *H01F 17/0013* (2013.01); *H01F 2017/002* (2013.01); *H01F 2017/0026* (2013.01); *H01F 2017/0086* (2013.01); *H01F 2027/2809* (2013.01)

(58) Field of Classification Search
CPC ..... H01F 27/2847
USPC ..... 336/200, 223, 232
See application file for complete search history.

(56) References Cited

U.S. PATENT DOCUMENTS 7,482,904 B2 * 1/2009 Lee et al. ..... 336/200
2004/0075521 A1 * 4/2004 Yu et al. ..... 336/200
2006/0077028 A1 * 4/2006 Huang ..... 336/223
2009/0284339 A1 * 11/2009 Choi et al. ..... 336/200
2012/0319779 A1 12/2012 Kim et al.
2013/0154783 A1 6/2013 Kato
2014/0077919 A1 * 3/2014 Godoy et al. ..... 336/220

FOREIGN PATENT DOCUMENTS

EP 2 669 907 A1 12/2013
WO 2004/012213 A1 2/2004
WO 2005/096328 A1 10/2005

OTHER PUBLICATIONS

Ng, Kiat T., et al; "Design and Optimization of Monolithic RF Transformers on Silicon"; EuMA 2001; pp. 1-4.

Rotella et al; "Characterization, Design, Modeling, and Model Validation of Silicon on-Wafer M:N Balun Components Under Matched and Unmatched Conditions"; Digest of Papers IEEE Radio Frequency Integrated Circuits (RFIC) Symposium; pp. 291-294 (2004).

(Continued)

*Primary Examiner* — Elvin G Enad
*Assistant Examiner* — Ronald Hinson

(57) ABSTRACT

An integrated transformer comprising a primary coil and a secondary coil, the primary coil comprising a first subsection and a second subsection, the first subsection extending in a different plane to a plane in which the second subsection extends, the planes spaced from one another, the secondary coil comprising a first subsection and a second subsection, the first subsection extending in a different plane to a plane in which the second subsection extends, the planes spaced from one another, wherein the first subsection of the primary coil is stacked with the second subsection of the secondary coil and the second subsection of the primary coil is stacked with the first subsection of the secondary coil.

15 Claims, 3 Drawing Sheets

(56) References Cited

OTHER PUBLICATIONS

Long, John R.; "Monolithic Transformers for Silicon RF IC Design"; IEEE Journal of Solid-State Circuits, vol. 35, No. 9; pp. 1368-1382 (Sep. 2000).
Mariano, A., et al; "A Low Power and High Gain Double-Balanced Active Mixer with Integrated Transformer-Based Baluns Dedicated to 77 GHz Automotive Radar Applications"; 8$^{th}$ IEEE International NEWCAS Conference 2010; pp. 81-84 (2010).
Taris, T., et al; "mm-Waves Design Trends in BiCMOS Technology"; 2008 Joint 6th International IEEE Northeast Workshop on Circuits and Systems and TAISA Conference; pp. 375-379 (2008).
Costa, PhD Josep Cabanillas; "Analysis of Integrated Transformers and Its Application to RFIC Design"; report from Universitat de Barcelona (2002).
Deferm, Noel, et al; "A 100 GHz Transformer-Coupled Fully Differential Amplifier in 90 nm CMOS"; IEEE Radio Frequency Integrated Circuits Symposium; pp. 359-362 (2010).
Liu, Bo et al; "Synthesis of Integrated Passive Components for High-Frequency RF ICs Based on Evolutionary Computation and Machine Learning Techniques"; IEEE Transactions on Computer-Aided Design of Integrated Circuits and Systems, vol. 30, No. 10; pp. 1458-1468 (Oct. 2011).
Extended European Search Report for application 13290318.8 (Mar. 6, 2014).

* cited by examiner

INTEGRATED TRANSFORMER

CROSS-REFERENCE TO RELATED APPLICATIONS

This application claims the priority under 35 U.S.C. §119 of European patent application no. 13290318.8, filed on Dec. 18, 2013, the contents of which are incorporated by reference herein.

This invention relates to an integrated transformer. It also relates to a stacked integrated transformer for use in RF circuits. Further, the invention relates to an integrated circuit including said integrated transformer.

The formation of a transformer as an integrated component on a substrate requires careful design, particularly in high frequency and high performance applications (such as band Ku, K, Ka up to band W). Integrated transformers have application in local oscillators, such as voltage controlled oscillators (VCO) and filters. Integrated transformers may be used in various applications and as part of different components each of which may include design challenges comprising limited tuning range, VCO pulling and tight requirements in terms of phase noise performance and efficiency requirements.

According to a first aspect of the invention we provide an integrated transformer comprising a primary coil and a secondary coil, the primary coil comprising a first subsection and a second subsection, the first subsection extending in a different plane to a plane in which the second subsection extends, the planes spaced from one another, the secondary coil comprising a first subsection and a second subsection, the first subsection extending in a different plane to a plane in which the second subsection extends, the planes spaced from one another, wherein the first subsection of the primary coil is stacked with the second subsection of the secondary coil and the second subsection of the primary coil is stacked with the first subsection of the secondary coil.

This is advantageous as the first and second subsections of the primary and secondary coils or "windings" are arranged face to face such that they are stacked together. This design provides excellent response symmetry. One of the subsections of the primary coil will overlay one of the subsections of the secondary coil while the other subsection of the secondary coil will overlay the other subsection of the primary coil.

The first subsection of each of the primary and secondary coils may extend in an upper plane and the second subsection of each of the primary and secondary coils extends in a lower plane. Thus, the primary coil extends over two planes and the second coil extends over two planes, the coils arranged together such than the two planes of the primary coil are aligned with the two planes of the secondary coil.

The first subsection of each of the primary and secondary coils may be arranged in a loop. The second subsection of each of the primary and secondary coils may be arranged in a loop. Thus, each subsection comprises a loop in its coil. Accordingly, the first and second subsections of the primary coil and the first and second subsections of the secondary coil may be each arranged in a figure of eight configuration or, more generally, a twisted configuration with a crossover.

The first subsection and second subsection of the primary coil and the first subsection and the second subsection of the secondary coil may each be substantially octagonal. The first subsection and the second subsection of the primary coil and the first subsection and the second subsection of the secondary coil may each be substantially oval or circular or square.

For both of the primary and secondary coils, the first subsection may include two connecting ends for connecting to two corresponding connecting ends of the second subsection of the same coil, the connecting ends connected, between the different planes in which the subsections lie, by connector fingers.

The connector fingers may be narrower than a conductive track from which they extend, the primary and secondary coils formed by said conductive track.

The connector fingers may extend in same plane as the subsection from which they extend and include a via at their end to traverse the different planes to connect to the connecting end of the other subsection. Thus, the fingers may provide the connection between the subsections of each of the coils.

For both the primary and secondary coils, one of the connecting ends of the first subsection may include one or more first connector fingers and one of the connector ends of the second subsection of the same coil includes one or more second connector fingers, the first and second connector fingers arranged to cross over one another in the different planes in an interconnection region.

The one or more connector fingers of the first subsection of the primary coil may be interleaved with and extend in the same plane as the one or more connector fingers of the first subsection of the secondary coil. The one or more connector fingers of the second subsection of the primary coil may be interleaved with and extend in the same plane as the one or more connector finger of the second subsection of the secondary coil.

Optionally, two connector fingers may be provided on one of the first subsections and one connector finger on the other of the first subsections. Optionally, two connector fingers may be provided on one of the second subsections and one connector finger on the other of the second subsections.

The first subsection of each of the primary and secondary coils may include coil terminals for providing a connection to the coils. Alternatively, the coil terminals may be provided in the second subsections. The coil terminals may be provided on an opposite side of the subsection to the interconnection region.

Each subsection may include two turns located in the same plane as the subsection. The first subsection may include an outer turn and an inner turn. The two turns of the second subsection may include a bridge section such that the turns cross over one another, the bridge section extending in a third plane, different to the plane in which the first subsection and second subsection of the coils extend.

Thus, for an integrated transformer having two or more turns, the primary and/or secondary coil is configured to extend over three distinct layers, the first subsection in a first layer, the second subsection in a second layer and the bridge section, providing an interchange in relative position of the turns in the second subsection, in a third layer.

According to a second aspect of the invention we provide an oscillator including the integrated transformer as defined in the first aspect of the invention. The use of the transformer as the inductive element of an L,C based resonator within the local oscillator is advantageous.

According to a third aspect of the invention we provide an integrated circuit for a RF device including the integrated transformer of the first aspect of the invention.

There now follows, by way of example only, a detailed description of embodiments of the invention with reference to the following figures, in which.

Figure 1:
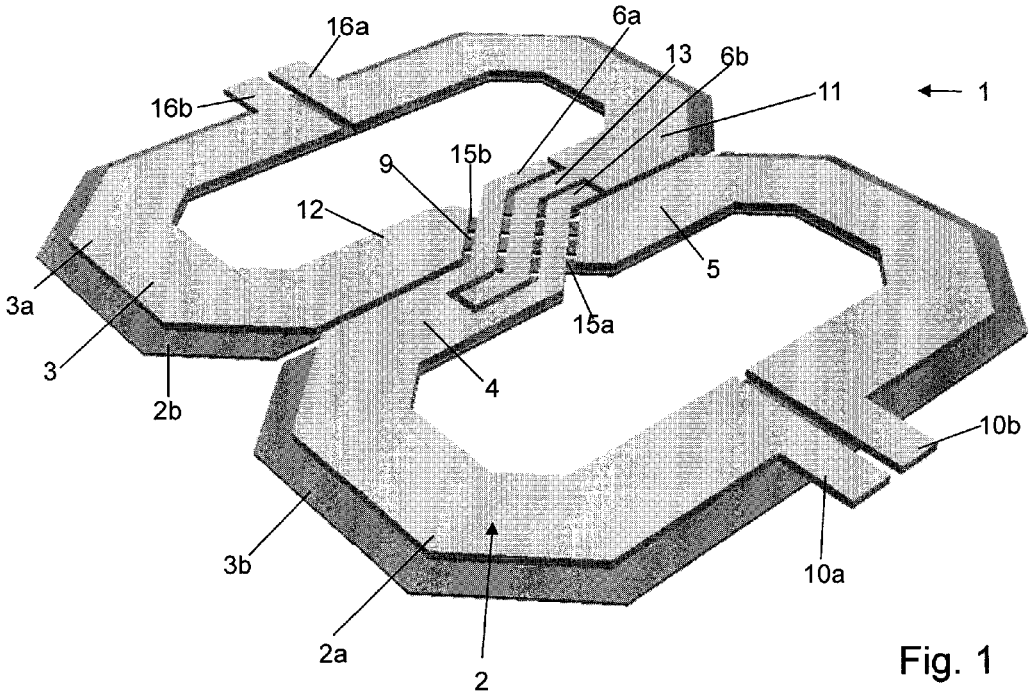
FIG. 1 shows a perspective view of the layout of the primary and secondary coils of the integrated transformer.

FIG. 1 shows an embodiment of a layout of an integrated transformer 1. The transformer 1 is for fabrication in a substrate 20 (such as silicon or GaAs) of an integrated circuit and thus comprises an on-chip monolithic transformer. The integrated circuit may solely contain the transformer 1 or it may be integrated with other components. The transformer 1 is particularly suited for RF and millimeter wave applications, such as in high performance local oscillators and filters.

Figure 2:
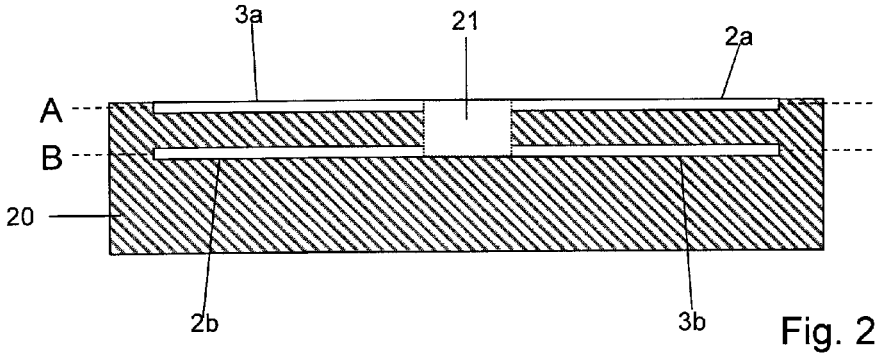
FIG. 2 shows a sectional side view through the substrate in which the coils of FIG. 1 are formed.

The integrated transformer 1 comprises a primary coil 2 and a secondary coil 3. The primary and secondary coils are configured, as is conventional, to transfer energy between them by inductive coupling. The primary coil 2 comprises a first subsection 2*a* and a second subsection 2*b*. The first subsection 2*a* extends in a first plane A and the second subsection extends in a second plane B (as shown in FIG. 2). The first plane or "upper plane" comprises, in this embodiment, an upper metal layer in the substrate 20 while the second plane or "lower plane", in this embodiment, comprises a metal layer lower in the substrate than the upper plane B. Thus, the subsections 2*a* and 2*b* extend in different planes wherein the upper and lower planes are spaced and electrically isolated from one another, by way of having substrate between them.

Likewise, the secondary coil 3 comprises a first subsection 3*a* and a second subsection 3*b*. The first subsection 3*a* extends in the first plane A and the second subsection 3*b* extends in the second plane B. Thus, the subsections 3*a* and 3*b* extend in different planes wherein the upper and lower planes are spaced and electrically isolated from one another having substrate between.

The first subsection 2*a* of the primary coil 2 is stacked on top of the second subsection 3*b* of the secondary coil 3. Further, the first subsection 3*a* of the secondary coil 3 is stacked on top of the second subsection 2*b* of the primary coil 2. The connections between the subsections 2*a*, 2*b*, 3*a*, 3*b* of the coils 2, 3 are located in an interconnect region 21.

The first and second coils 2 and 3 are each, in plan view, arranged in a figure of eight configuration in which half of the figure of eight is located in the upper plane and the other half is located in the lower plane. Each subsection 2*a*, 2*b*, 3*a*, 3*b* is substantially octagonal. However, it will be appreciated that the subsections may have other shapes, such as oval, circular, square, pentagonal, hexagonal, or any other appropriate shape. The subsections 2*b* and 3*b* in the lower plane B have a larger area than the subsections in the upper plane A. The coils 2, 3 are formed by a conductive track formed on the silicon substrate 20. The conductive track forms a first loop by way of the first subsection and a second loop, turning in the opposite direction, by way of the second subsection.

Figure 3:
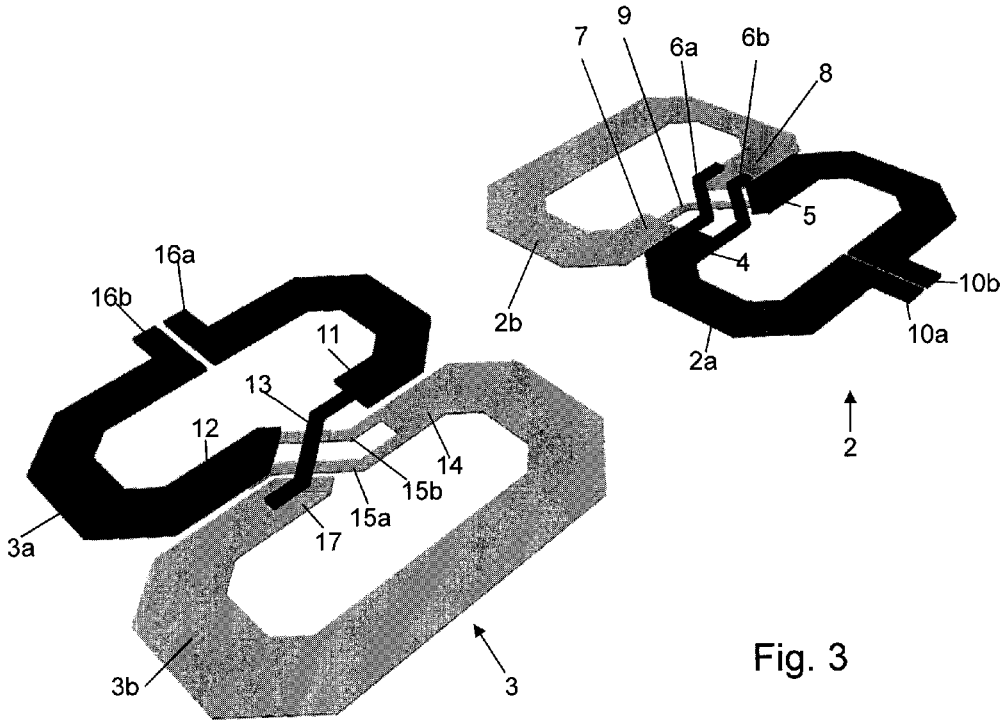
FIG. 3 shows the primary coil separated from the secondary coil.

FIG. 3 shows the primary coil 2 and secondary coil 3 arranged side by side for clarity.

Referring first to the primary coil 2, the first subsection 2*a* includes two connecting ends; a first connecting end 4 and a second connecting end 5. The connecting ends are formed by a break in the conductive track of the first subsection. The first connecting end 4 includes two connector fingers 6*a* and 6*b* extending therefrom the end 4 in the upper plane. The second connecting end 5 does not include a connector finger. The second subsection 2*b* also includes two connecting ends; a first connecting end 7 and a second connecting 8. The first connecting end 7 includes a single connector finger 9 extending therefrom in the same, lower plane B as the second section 2*b*.

The two connector fingers 6*a* and 6*b* include vias (not visible) at their distal ends to form an interconnection between the fingers 6*a*, 6*b* of the first connecting end 4 of the first subsection 2*a* and an upper surface of the second connecting end 8 of the second subsection 2*b*. The vias transverse the gap between the upper plane A and the lower plane B.

The connector finger 9 includes a via (not visible) at its distal end to form an interconnection between the finger 9 of the first connecting end 7 of the second subsection 2*b* and a lower surface of the second connecting end 5 of the first subsection 2*a*. The via transverses the gap between the lower plane B and the upper plane A. Thus, the fingers 6*a* and 6*b* in the upper layer cross over the finger 9 in the lower layer in the interconnect region 21. The fingers 6*a*, 6*b* are substantially perpendicular to the finger 9 as they cross.

The first subsection 2*a* includes two coil terminals 10*a* and 10*b* for connecting the primary coil 2 to other components. A current entering the terminal 10*a* must follow the figure of eight path before reaching the terminal 10*b*.

Turning now to the secondary coil 3, the first subsection 3*a* includes two connecting ends; a first connecting end 11 and a second connecting end 12. The connecting ends are formed by a break in the conductive track of the first subsection 3*a*. The first connecting end 11 includes a single connector finger 13 extending therefrom the end 11 in the upper plane. The second connecting end 12 does not include a connector finger. The second subsection 3*b* also includes two connecting ends; a first connecting end 14 and a second connecting 17. The first connecting end 14 includes two connector fingers 16*a*, 16*b* extending therefrom in the same, lower plane B as the second section 3*b*.

The connector finger 13 includes a via (not visible) at its distal end to form an interconnection between the finger 13 of the first connecting end 11 of the first subsection 3*a* and an upper surface of the second connecting end 17 of the second subsection 3*b*. The vias transverse the gap between the upper plane A and the lower plane B.

The connector fingers 15*a*, 15*b* includes vias (not visible) at their distal ends to form an interconnection between the fingers 15*a*, 15*b* of the first connecting end 14 of the second subsection 3*b* and a lower surface of the second connecting end 12 of the first subsection 3*a*. The vias transverses the gap between the lower plane B and the upper plane A. Thus, the fingers 15*a* and 15*b* in the lower layer cross under the finger 13 in the upper layer in the interconnect region 21. The fingers 15*a*, 15*b* are substantially perpendicular to the finger 13 as they cross. The fingers thus allow the conductive tracks to cross without an electrical interconnection between the primary and secondary coils.

The first subsection 3*a* includes two coil terminals 16*a* and 16*b* for connecting the secondary coil to other components. A current entering the terminal 16*a* must follow the figure of eight path before reaching the terminal 16*b*.

FIG. 1 shows the primary coil and secondary coil arranged together wherein the primary and secondary coils 2, 3 stacked together with the first subsection of each coil overlaying the second subsection of the other coil. It will be appreciated that the substrate extends between the coils acting as a dielectric.

The fingers 6*a* and 6*b* of the first subsection 2*a* of the primary coil 2 are interleaved with the finger 13 of the first subsection 3*a* of the secondary coil 3. The fingers 6*a*, 6*b* and 13 extend in the same plane when the coils are arranged together. The provision of two fingers 6*a*, 6*b* arranged at the outer edges of the conductive track that forms the first subsection 2*a* allows the finger 13 to extend in the gap between the fingers 6*a*, 6*b*.

The fingers 15*a*, 15*b* of the second subsection 3*b* of the secondary coil 3 are interleaved with the finger 9 of the second subsection 2*b* of the primary coil 2. The fingers 15*a*, 15*b* and 9 extend in the same plane when the coils 2, 3 are arranged together. The provision of two fingers 15*a*, 15*b* arranged at the outer edges of the conductive track that forms the second subsection 3*b* allows the finger 9 to extend in the gap between the fingers 15*a*, 15*b*.

It will be appreciated that further fingers may be provided. For example, each of the connecting ends may include two spaced fingers, the fingers configured to be interleaved over the interconnection region 21. Alternatively, two fingers on one of the connecting ends of the primary coil may be interleaved with three fingers on the opposing connecting end of the secondary coil.

In summary, the first and second subsections of each coil are connected together by fingers that extend in the same plane as the subsection from which they project and include vias to transition between the planes. Further, the fingers of the primary coil and the fingers of the secondary coil are arranged such that they are interleaved in the plane in which they extend, thus extending side by side. This arrangement provides an efficient use of die area in the interconnect region to connect the subsections together. The fingers provide the part of the conductive track that allows the primary coil and secondary coil to overlap one another before the vias at the ends of the fingers provide the interconnection between the planes A and B.

The invention provides a high level of integration, a symmetrical response of transformer which is advantageous for Local Oscillator and a good quality-factor and device footprint. It has also been found that this design has better immunity to pulling from adjacent blocks.

Figure 4:
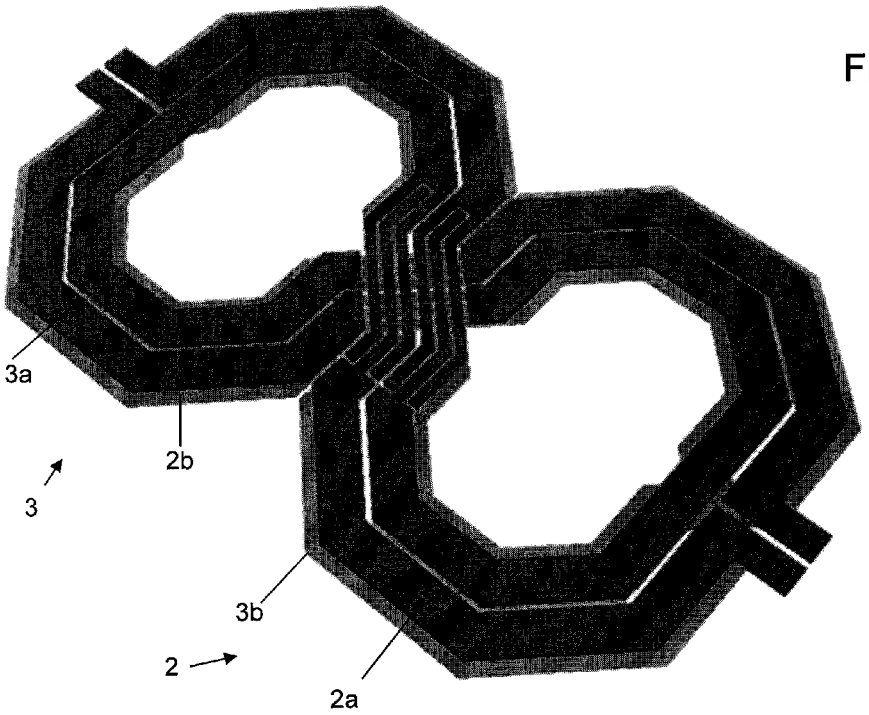
FIG. 4 shows a perspective view of the layout of the primary and secondary coils of a second embodiment of the integrated transformer.
Figure 5:
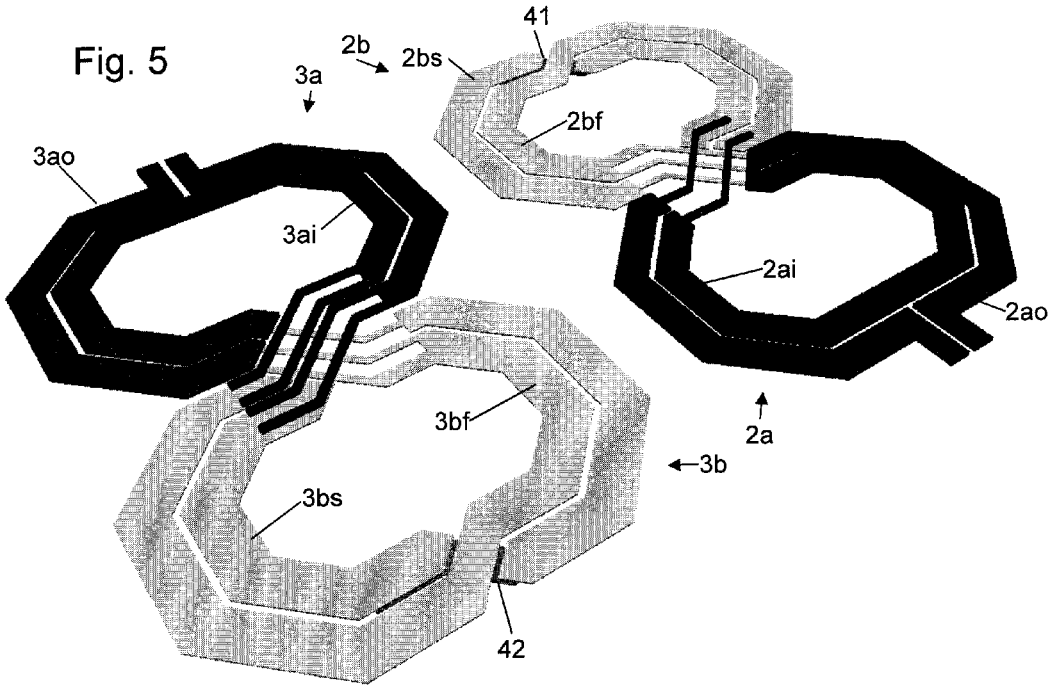
FIG. 5 shows a top view of the primary coil separated from the secondary coil of the integrated transformer of FIG. 4.
Figure 6:
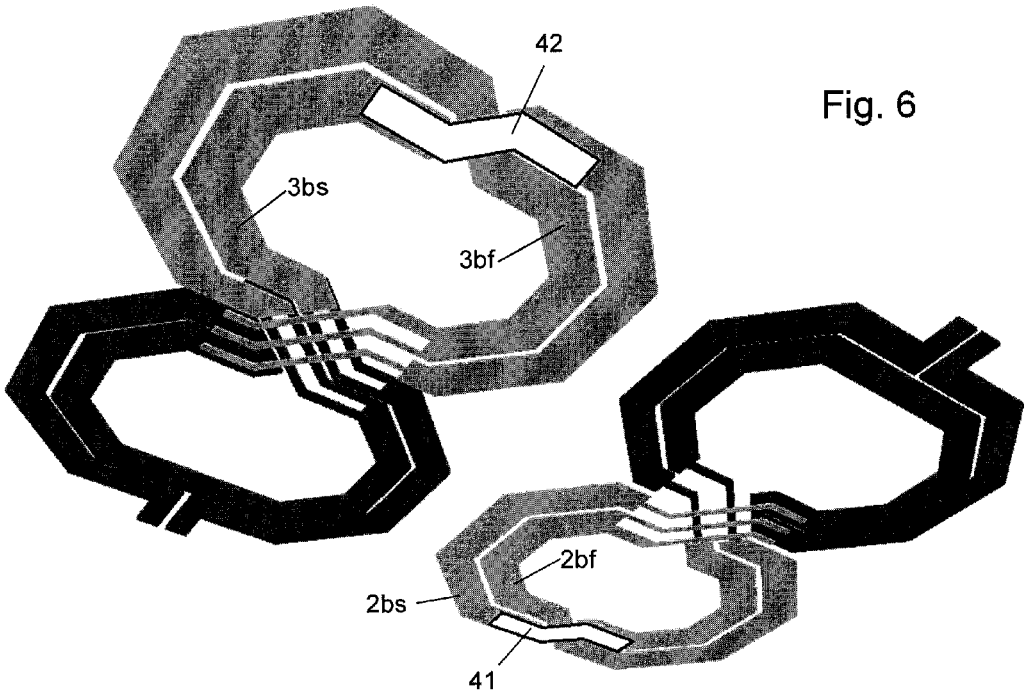
FIG. 6 shows a bottom view of the primary coil separated from the secondary coil of the integrated transformer of FIG. 4.

FIGS. 4 to 6 show a second embodiment of the integrated transformer in which the primary coil includes two turns and the secondary coil includes two turns. In this embodiment the first subsection of the primary coil includes an outer turn 2*ao* and an inner turn 2*ai*. The second subsection of the primary coil includes a first turn 2*bf* and a second turn 2*bs*. The inner and outer turns and the first and second turns extend in the same plane as the subsection of which they form part. Likewise, the first subsection of the secondary coil includes an outer turn 3*ao* and an inner turn 3*ai*. The second subsection of the secondary coil also a first turn 3*bf* and a second turn 3*bs*. The inner and outer turns and the first and second turns extend in the same plane as the subsection of which they form part.

The outer turn 2*ao* of the first subsection extends in a first, upper plane. This outer turn 2*ao* connects to the first turn 2*bf* of the second subsection, which lies in a second, intermediate plane. The first turn 2*bf* crosses over the second turn 2*bs* at a cross over region 40, opposite the interconnect region 21. The other end of the first turn 2*bf* connects to the inner turn 2*ai* of the first subsection. The other end of the inner turn 2*ai* connects to the second turn of the second subsection. The second turn 2*bs* crosses the first turn 2*bi* at the cross over region 40. The second turn 2*bs* includes a bridge section 41 to enable it to cross the first turn 2*bf*. The bridge section 41 extends in a third, lower plane. Thus, this embodiment of a two turn integrated transformer extends over three distinct planes. The second turn 2*bs*, after the bridge section 41, connects to the outer turn 2*ao* of the first subsection to complete the primary coil 2. The connections between the various turns is achieved by fingers, as in the previous embodiment, in the interconnect region 21 between the first and second subsections.

The secondary coil 3 has a similar construction to the primary coil 2 in terms of the connections between the outer turn 3*ao* and the first turn 3*bf*, the first turn 3*bf* and the inner turn 3*ai*, the inner turn 3*ai* and the second turn 3*bs*, a further bridge section 42 located in the third plane, and the connection between the second turn 3*bs* and the outer turn 3*ao*.

The primary and secondary coils 2, 3 are stacked together such that the first subsections lie in the first, upper plane, the second subsections lie in the second, intermediate plane and the bridge sections 41, 42 lie in a third, lower plane. The fingers of each of the turns that lie in the same plane and face one another are interleaved, as in the first example.

The invention claimed is:

1. An integrated transformer comprising:

a primary coil and a secondary coil;

the primary coil comprising a first subsection and a second subsection, the first subsection extending in a different plane to a plane in which the second subsection extends, the planes spaced from one another, the secondary coil comprising a first subsection and a second subsection, the first subsection extending in a different plane to a plane in which the second subsection extends, the planes spaced from one another, wherein the first subsection of the primary coil is stacked with the second subsection of the secondary coil and the second subsection of the primary coil is stacked with the first subsection of the secondary coil;

wherein the first subsection of each coil extends in an upper plane and the second subsection of each coil extends in a lower plane;

wherein the first subsection of each coil is arranged in a loop;

wherein the second subsection of each coil is arranged in a loop;

wherein the first and second subsections of the primary coil and the first and second subsections of the secondary coil are each arranged in a figure of eight configuration;

wherein, for both of the primary and secondary coils, the first subsection includes two connecting ends for connecting to two corresponding connecting ends of the second subsection of the same coil, the connecting ends connected, between the different planes in which the subsections lie, by connector fingers that extend from conductive tracks that form the first subsections and for both of the primary and secondary coils, the second subsection includes two connecting ends for connecting to two corresponding connecting ends of the first subsection of the same coil, the connecting ends connected, between the different planes in which the subsections lie, by connector fingers that extend from conductive tracks that from the second subsections;

wherein the connector fingers are narrower than a conductive track from which they extend, the primary and secondary coils formed from said conductive track;

wherein the connector fingers extend in the same plane as the subsection from which they extend and include a via at their end to traverse the different planes to connect to the connecting end of the other subsection;

wherein, for both the primary and secondary coils, one of the connecting ends of the first subsection includes a first connector finger and one of the connector ends of the second subsection of the same coil includes a second connector finger, the first and second connector fingers arranged to cross over one another in the different planes in an interconnection region;

wherein the connector finger of the first subsection of the primary coil is side-by-side with and extends in the same plane as the connector finger of the first subsection of the secondary coil; and wherein the connector finger of the second subsection of the primary coil is side-by-side with and extends in the same plane as the connector finger of the second subsection of the secondary coil;

wherein one subsection of the primary coil includes multiple fingers that extend from a connecting end of the subsection and have a gap between the multiple fingers and wherein one subsection of the secondary coil includes a finger in the same plane as the multiple fingers and that extends in the gap between the multiple fingers.

2. An integrated transformer as defined in claim 1, in which the first subsection and second subsection of the primary coil and the first subsection and the second subsection of the secondary coil are each substantially octagonal.

3. An integrated transformer as defined in claim 1, in which the first subsection and second subsection of the primary coil and the first subsection and the second subsection of the secondary coil are each substantially oval or square.

4. An integrated transformer as defined in claim 1, in which the first subsection of each of the primary and secondary coils includes coil terminals for providing a connection to the coils.

5. An oscillator including the integrated transformer as defined in claim 1.

6. An integrated circuit for a RF device including the integrated transformer of claim 1.

7. An integrated transformer as defined in claim 1, wherein the combined width of the side-by-side fingers does not exceed the width of the corresponding conductive track.

8. An integrated transformer as defined in claim 1, wherein the subsections in the lower plane have a larger area than the subsections in the upper plane.

9. An integrated transformer as defined in claim 1, wherein one subsection of the secondary coil includes multiple fingers that extend from a connecting end of the subsection and have a gap between the multiple fingers and wherein one subsection of the primary coil includes a finger in the same plane as the multiple fingers and that extends in the gap between the multiple fingers.

10. An integrated transformer comprising:

a primary coil; and a secondary coil;

the primary coil comprising a first subsection and a second subsection, the first subsection extending in a different plane to a plane in which the second subsection extends, the planes spaced from one another, the secondary coil comprising a first subsection and a second subsection, the first subsection extending in a different plane to a plane in which the second subsection extends, the planes spaced from one another, wherein the first subsection of the primary coil is stacked with the second subsection of the secondary coil and the second subsection of the primary coil is stacked with the first subsection of the secondary coil;

wherein the first subsection of each coil extends in an upper plane and the second subsection of each coil extends in a lower plane;

wherein the first subsection of each coil is arranged in a loop;

wherein the second subsection of each coil is arranged in a loop;

wherein the first and second subsections of the primary coil and the first and second subsections of the secondary coil are each arranged in a figure of eight configuration;

wherein, for both of the primary and secondary coils, the first subsection includes two connecting ends for connecting to two corresponding connecting ends of the second subsection of the same coil, the connecting ends connected, between the different planes in which the subsections lie, by connector fingers that extend from conductive tracks that form the first subsections and for both of the primary and secondary coils, the second subsection includes two connecting ends for connecting to two corresponding connecting ends of the first subsection of the same coil, the connecting ends connected, between the different planes in which the subsections lie, by connector fingers that extend from conductive tracks that from the second subsections;

wherein the connector fingers are narrower than a conductive track from which they extend, the primary and secondary coils formed from said conductive track;

wherein the connector fingers extend in the same plane as the subsection from which they extend and include a via at their end to traverse the different planes to connect to the connecting end of the other subsection;

wherein, for both the primary and secondary coils, one of the connecting ends of the first subsection includes a first connector finger and one of the connector ends of the second subsection of the same coil includes a second connector finger, the first and second connector fingers arranged to cross over one another in the different planes in an interconnection region;

wherein the connector finger of the first subsection of the primary coil is interleaved with and extends in the same plane as the connector finger of the first subsection of the secondary coil;

wherein the connector finger of the second subsection of the primary coil is interleaved with and extends in the same plane as the connector finger of the second subsection of the secondary coil;

wherein the first subsection of each of the primary and secondary coils includes coil terminals for providing a connection to the coils;

wherein one subsection of the primary coil includes multiple fingers that extend from a connecting end of the subsection and have a gap between the multiple fingers and wherein one subsection of the secondary coil includes a finger in the same plane as the multiple fingers and that extends in the gap between the multiple fingers.

11. An oscillator including the integrated transformer as defined in claim 10.

12. An integrated circuit for a RF device including the integrated transformer of claim 10.

13. An integrated transformer as defined in claim 10, wherein the combined width of the interlaced fingers does not exceed the width of the corresponding conductive track.

14. An integrated transformer as defined in claim 10, wherein the subsections in the lower plane have a larger area than the subsections in the upper plane.

15. An integrated transformer as defined in claim 10, wherein one subsection of the secondary coil includes multiple fingers that extend from a connecting end of the subsection and have a gap between the multiple fingers and wherein one subsection of the primary coil includes a finger in the same plane as the multiple fingers and that extends in the gap between the multiple fingers.

* * * * *